United States Patent [19]

Shigeru

[11] 4,358,912

[45] Nov. 16, 1982

[54] GRINDSTONE CLEARANCE CORRECTING DEVICE FOR SPRING GRINDING MACHINE

[76] Inventor: Watanabe Shigeru, 121, Oaza Shibiragi, Urawa-City, Saitama-Pre, Japan

[21] Appl. No.: 153,675

[22] Filed: May 27, 1980

[51] Int. Cl.[3] ..... B24B 49/04

[52] U.S. Cl. ..... 51/118; 51/165.88

[58] Field of Search ..... 51/111 R, 112, 116, 51/118, 165 R, 165.88

[56] References Cited

U.S. PATENT DOCUMENTS

| | | | |
|---|---|---|---|
| 2,845,755 | 8/1958 | Price | 51/112 |
| 2,882,650 | 4/1959 | Price | 51/112 |
| 3,001,336 | 9/1961 | Bauer | 51/165 R |
| 3,561,164 | 2/1971 | Dunn | 51/116 |
| 3,774,348 | 11/1973 | Dunn | 51/111 R |
| 4,217,734 | 8/1980 | Frei | 51/118 |

*Primary Examiner*—Harold D. Whitehead

*Attorney, Agent, or Firm*—Wenderoth, Lind & Ponack

[57] ABSTRACT

A grindstone clearance correcting device for spring grinding machine comprises a drive unit for driving a pair of grindstones for grinding both ends of a coil spring in a direction perpendicular to flat surface of a work table, and an extra length spring detecting unit for detecting an extra length spring whose grinding allowance is not removed due to the abrasion of the pair of grindstones, whereby the pair of grindstones are shifted by the driving unit in a predetermined quantity in a direction where the grindstones approach mutually.

2 Claims, 4 Drawing Figures

GRINDSTONE CLEARANCE CORRECTING DEVICE FOR SPRING GRINDING MACHINE

DESCRIPTION OF PRIOR ART

In the conventional coil spring grinding machines, when a pair of grindstones become worn by the continued grinding operation, and a predetermined amount of material is no longer removed from both ends of the spring, the pair of the grindstones are shifted in a direction to cause the grindstones to approach mutually by manual operation of the operator based on his judgement according to the abrasion being achieved by the grindstones and the clearance between the grindstones is corrected. Accordingly, the judgement of the abrasion achieved by the grindstones is dependent on the skilled operator's judgment, and he must be alert all the time to the abrasion achieved by the grindstones which has been troublesome to the operator.

SUMMARY OF THE INVENTION

This invention relates to a grindstone clearance correcting device for spring grinding machine.

A primary object of this invention is to correct the clearance between grindstones to a proper length by detecting a defective spring, namely, an extra long spring resulting from insufficient grinding, and automatically shifting a pair of grindstones on the basis of this detecting signal in a direction to cause the grindstones to approach mutually.

Another object of this invention is to provide a detection device which does not cause the upper and lower grindstones to be driven toward each other immediately upon the detection of a single extra long coil spring. When the upper and lower grindstones are shifted toward each other upon the detection of only a single defective spring, namely, an extra long spring, resulting in a smaller grindstone clearance, the amount of ground from the succeeding coil springs is increased more than a predetermined amount. In view of the foregoing circumstances, this invention causes the correcting operation of the clearance between a pair of grindstones only after the detection of a plurality of extra long springs in a fixed time, for example, three pieces in one minute.

DETAILED DESCRIPTION OF THE INVENTION

Figure 1:
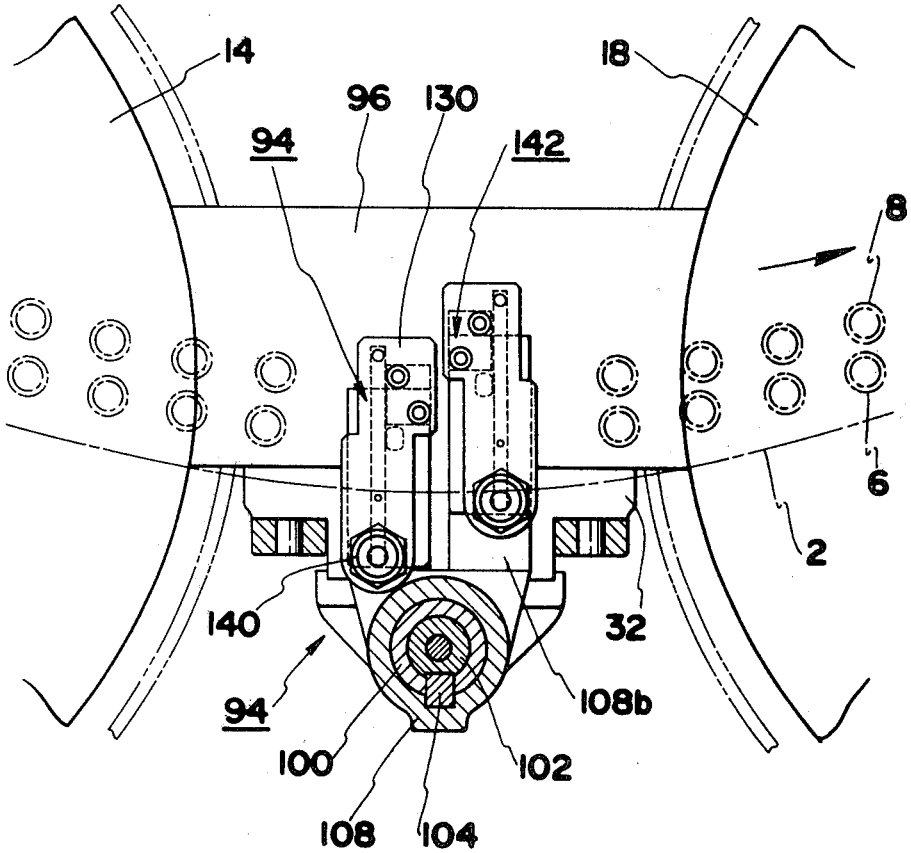
FIG. 1 is a plan view of a part of a coil spring grinding machine.
Figure 3:
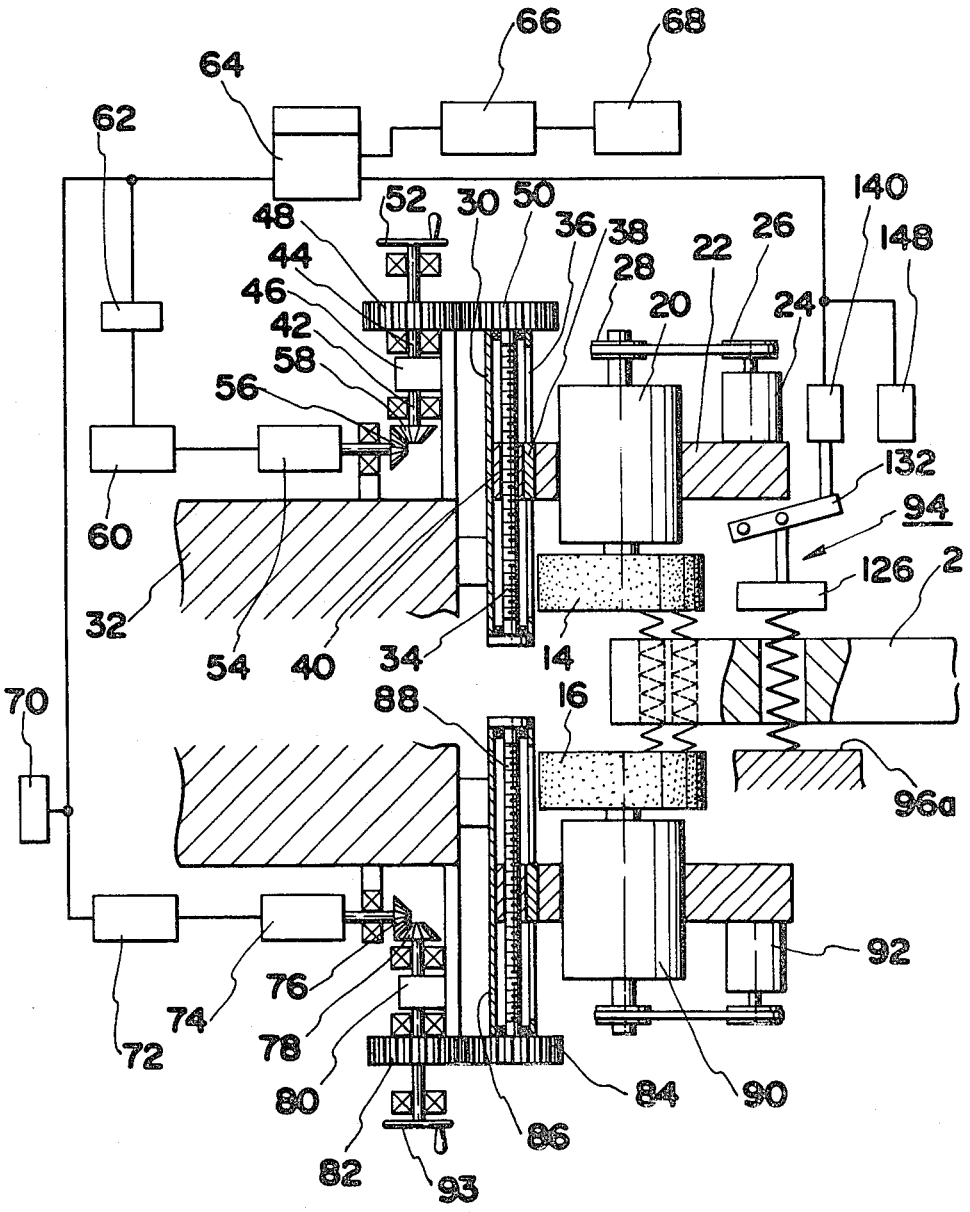
FIG. 3 is a general elevation view, partly in section of a coil spring grinding machine.
Figure 4:
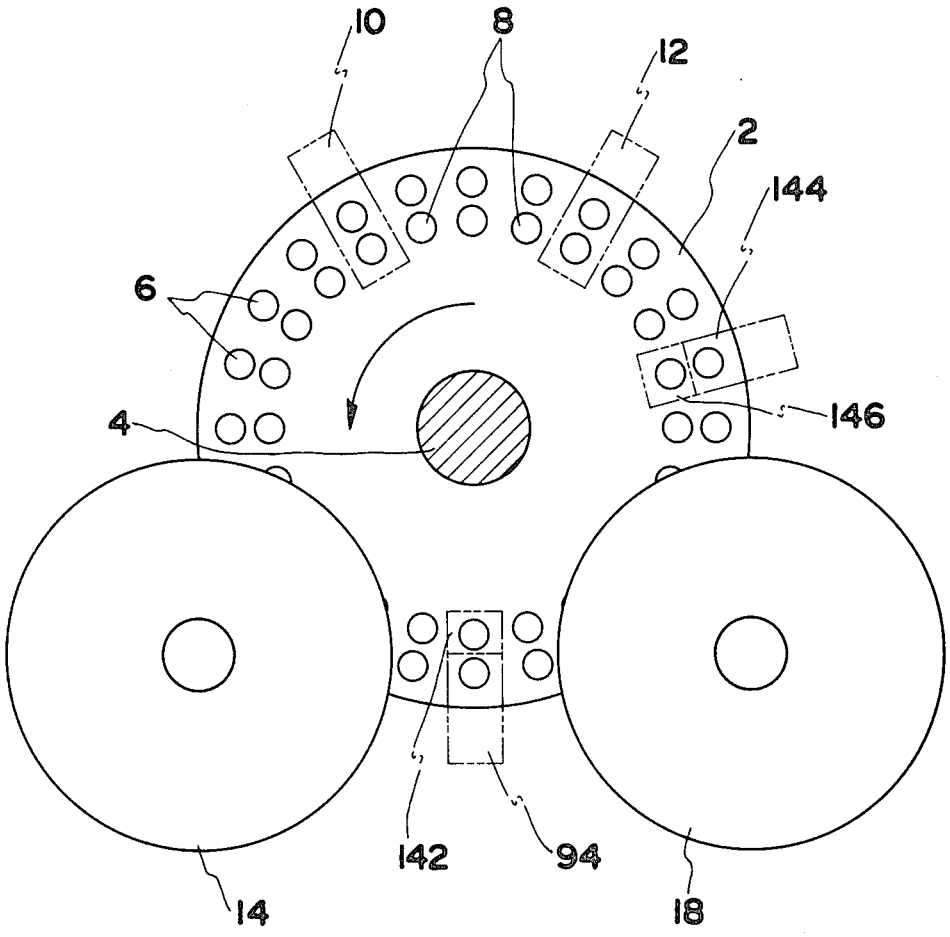
FIG. 4 is a plan view of a coil spring grinding machine.

In FIGS. 1 and 4, reference numeral 2 denotes a disc type work table, and its center is fixed to a table shaft 4, and the table shaft 4 is coupled with a rotary drive unit (not shown). On the outer periphery of the work table 2, a large number of spring holding holes 6 and 8 are formed at equal distances from each other in two parallel rows. Immediately above the spring holding holes 6 and 8 are disposed an automatic spring supply unit 10 and an automatic spring discharge. The rotary drive unit for driving the foregoing units 10 and 12 and the table shaft 4 has a well known structure, and also since it is not the gist of this invention, the illustration and description of a concrete example are omitted herein. Reference numeral 14 denotes an upper surface grindstone for rough grinding, and below it, a lower surface grindstone 16 for rough grinding with the work table 2 therebetween. Reference numeral 18 denotes an upper surface grindstone for finish grinding, and below it, a lower surface grindstone for finish grinding (not shown) with the work table 2 therebetween. The upper surface grindstone for rough grinding 14, as shown in FIG. 3, is fixed to an output shaft of a head 20 in which a speed reduction mechanism is built in. Reference numeral 22 denotes a head support plate, and the head 20 is fixed to the head support plate. A motor 24 is fixed on the support plate 22, and a belt pulley 26 is fixed to an output shaft of the motor 24. A belt extends between the belt pulley 26 and a pulley 28 fixed to an input shaft of the head 20. Reference numeral 30 denotes a cylinder fixed to a machine body 32, and a threaded shaft 34 is mounted on the cylinder by means of a ball bearing so as to be rotatable in a fixed position. In the side wall of the cylinder 30, a long hole 36 is formed in the longitudinal direction of the cylinder 30, and a locking member 38 is slidably fitted in the long hole 36. One part of the locking member 38 is fixed to the head support plate 22 and the other part of the locking member 38 is fixed to a cylindrical nut 40. The outer periphery of the nut slidably engages the inner periphery of the cylinder 30 and the nut is threaded on the shaft 34. Reference numerals 42 and 44 denote shafts rotatably supported on the machine body 32, and the shafts 42 and 44 are connected by means of an electromagnetic clutch 46. A gear 48 is fixed to the shaft 44, and the gear 48 is meshed with a gear 50 fixed to the upper end of the shaft 34. On one end of the shaft 44 is a handle 52 and a rotary type cylinder 54 is connected to an oil pressure (hydraulic) drive system (not shown). On the output shaft of the cylinder 54 is a bevel gear 56 is meshed with a bevel gear 58 fixed to one end of the shaft 42. Reference numeral 60 denotes an electromagnetic valve for controlling the drive direction of the cylinder 54, and the coil of the electromagnetic valve is connected electrically to the output side of a timer 62. Reference numerals 64 and 66 denote preset counters, and numeral 68 denotes a clock pulse generator, and numeral 70 denotes a buzzer. A reset terminal of the preset counter 64 is connected to the output terminal of the preset counter 66. In this embodiment, a pulse generator 68 outputs two pulses in one second, and this clock pulse is designed to be inputted to the preset counter 66. Reference numeral 72 denotes an electromagnetic valve, numeral 74 denotes a rotary type oil pressure (hydraulic) cylinder, numerals 76 and 78 denote bevel gears, numeral 80 denotes an electromagnetic clutch numerals 82 and 84 denote gears, numeral 86 denotes a cylinder, numeral 88 denotes a threaded shaft, numeral 90 denotes a head, numeral 92 denotes a motor, numeral 93 denotes a handle, these last mentioned parts driving the lower surface grindstone 16 for rough grinding in the same manner as the upper surface grindstone 14 is driven. Reference numeral 94 denotes an extra long spring detecting unit for rough grinding, and which is disposed just past the rough grinding position.

Figure 2:
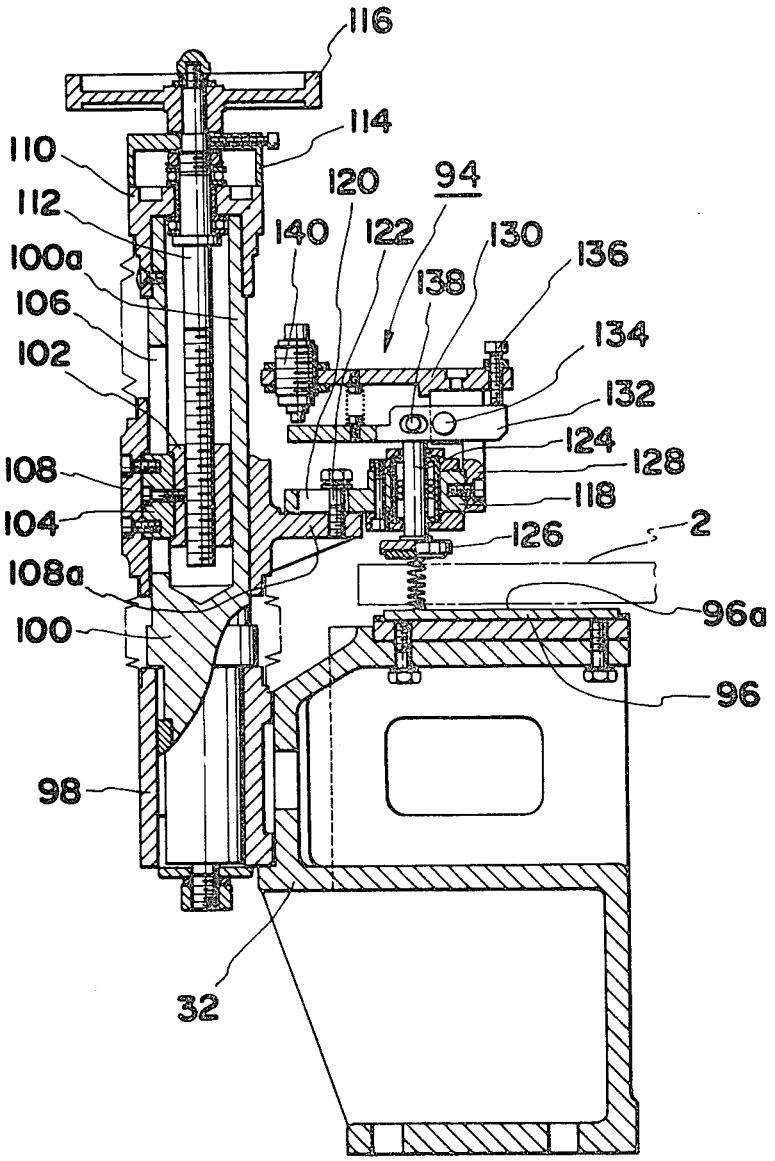
FIG. 2 is a vertical cross section of an extra long coil spring detecting device.

Next, construction of the extra long spring detecting unit 94 will described by referring to FIGS. 1 and 2.

A spring mounting plate 96 is fixed to the body 32 below the lower surface of the work table 2 with a predetermined clearance therebetween. Reference numeral 98 denotes a tubular body fixed to the machine body 32, and a support shaft 100 is fixed in the tubular body. The support shaft 100 is disposed parallel with the table shaft 4. A tubular nut member 102 is slidably fitted in a tubular portion 100*a* of the support shaft 100. Reference numeral 104 denotes a locking member slidably fitted in a long hole 106 formed in the side wall of the tubular portion 100*a*, and the locking member is fixed to the nut member 102. Reference numeral 108 denotes a lifting tube slidably mounted the outer periphery of the tubular portion 100*a*, and the lifting tube 108 is fixed to the locking member 104. Projecting members 108*a* and 108*b* are integrally formed on the lifting tube 108. Reference numeral 110 denotes a dial tube fixed to the upper portion of the tubular portion 100*a*, and a shaft portion of a threaded shaft 112 is rotatably mounted in the dial tube 110 at a fixed position. The nut member 102 is threaded on the shaft 112. Reference numeral 114 denotes a dial cylinder fixed to the shaft portion of the threaded shaft 112, and on the dial cylinder 114 is a graduation and on the outer periphery of the dial tube 110 is an index mark. Reference numeral 116 denotes a handle fixed to the upper end of the shaft 112. Reference numeral 118 denotes an adjusting plate, and a long through hole is formed in the adjusting plate 118, and a bolt 122 threadedly engaged in a hole in the projecting member 108*a* is disposed in the long hole 120. Reference numeral 124 denotes a shaft slidably mounted in a vertical hole in the adjusting plate 118 by means of a slide ball bearing, and a disc member 126 made of super hard metal is fixed to the lower end thereof. Reference numeral 128 denotes a bracket fixed to the adjusting plate 118, and a support plate 130 is fixed to the upper end of the bracket 128. Reference numeral 132 denotes an oscillating arm mounted on the side surface of the bracket 128 by means of a rotatable shaft 134, and one end of the oscillating arm 132 resiliently contacts the lower end of a stop screw 136 mounted at the end portion of the support plate 130. The upper end of the shaft 124 is mounted rotatably on the oscillating arm 132 by means of the shaft 138. Reference numeral 140 denotes a contact switch fixed to the support plate 130, and the lower end of the detecting element thereof is opposed to the upper surface of the other end of the oscillating arm 132 with a certain clearance therebetween. Instead of the switch 140, a proximity switch or a similar switch may be used. An extra long spring detecting unit 142 having the same construction as that of the extra long spring detecting unit 94 the primary members of which are the disc member 126, oscillating arm 132 and the switch 140 is mounted on the projecting member 108*b*. Furthermore, just beyond the position of the finish grinding operation, extra long spring detecting units 144 and 146 having the same construction as that of the above described extra long spring detecting unit 94 are provided for each row of the spring holding holes 6, 8. Reference numeral 148 in FIG. 3 denotes the contact switch of the detecting unit 142.

Next, the operation of this embodiment will be described.

In the first place, the electromagnetic clutches 46 and 80 are de-energized and the handles 52 and 93 are turned to set the clearance between the grindstones 14 and 16 to a predetermined clearance. The clutches 46 and 80 are energized and then the bolt 122 is loosened and the adjusting plate 118 is adjusted in the right and left direction in FIG. 2 so that the disc member 126 is positioned immediately above the line of the outside spring holding holes on the table 2, and the bolt 122 is tightened to fix the adjusting plate 118 to the projecting member 108*a*. Similarly, the disc member (not shown) of the extra long spring detecting unit 142 is positioned immediately above the line of the spring holding holes 8 on the inside of table 2. Next, the handle 116 is operated to raise the lifting tube 108 along the outer periphery of the tubular portion 100*a* so as to set the height of the lower surface of the disc member 126 above the spring support surface 96*a* to a predetermined height. If the amount ground from both ends of the coil spring becomes small due to the grinding operation of the grindstones 14, 16, and the length of the coil spring after the grinding exceeds the tolerance value, the height of the disc member 126 above the support surface 96*a* is such that the upper end of the extra long coil spring abuts the disc member 126.

Next, the preset counter 64 is set to, for example, "3", and the preset counter 66 is set to, for example, 120 which is the number of pulses in one minute. By the foregoing manipulation, the preset counter 66 outputs reset signals to the preset counter 64 each minute.

Next, the work table 2 is driven in the direction of the arrow at a predetermined speed, and the motors 24 and 92 are operated to rotatably drive the grindstones 14 and 16 at a high speed.

The coil springs are continuously inserted into the holding holes 6 and 8 of the work table 2 by means of the automatic supply unit 10. The coil springs inserted into the holding holes 6 and 8 are brought to the grindstones 14 and 16 by the rotation of the work table 2, and both end portions are roughly ground at this station. Thereafter, the coil springs are brought to the grindstone 18 and the opposed lower grindstone (not shown), and both the end portions are finish ground. The finish ground coil springs are brought to the automatic discharge unit 12, and are dropped into a coil spring collecting vessel (not shown) disposed below the work table 2.

When the grindstones 14 and 16 become worn, the clearance between the grindstones 14 and 16 becomes bigger. When the extra long coil springs begin to appear when this condition occurs, each extra long coil spring abuts the disc member 126, and the disc member 126 is instantly lifted up. The lifting shaft 124 is lifted by the rising of the disc member 126, and the oscillating arm 132 is oscillated in the clockwise direction around the shaft 134 as shown in FIG. 2, and one end of the oscillating arm 132 comes into contact the detecting member of the contact switch 140. By this contact, the switch 140 outputs one pulse and this pulse is inputted to the preset counter 64, and the pulses are counted by the preset counter 64.

The preset counter 64 does not output pulses unless three pulse signals are inputted in succession to the preset counter 64 in one minute from the switch 140 or 148.

When the three pulses are inputted to the preset counter 64 in one minute, the preset counter 64 outputs a pulse, and this pulse is inputted to the coil of the electromagnetic valve 72. Furthermore, this pulse is supplied to the coil of the electromagnetic valve 60 by means of the timer 62 and also the buzzer 70 is operated. When the pulse is supplied to the coil of the electromagnetic valve 72, the plunger of the electromagnetic valve 72 is driven, and the rotary type cylinder 74 is driven, and the output shaft of the cylinder 74 is rotated through a predetermined angle. The rotation of the output shaft of the cylinder 74 is transmitted to the threaded shaft 88, and the shaft 88 is rotated.

The head 90 is raised by the rotation of the shaft 88, and the lower grindstone 16 is lifted a predetermined distance. On the other hand, the pulse supplied by the timer 62 is supplied to the coil of the electromagnetic valve 60 after a delay of a predetermined length, and the plunger of the electromagnetic valve 60 is driven, and the cylinder 54 is driven.

The threaded shaft 34 is rotated a predetermined amount by the cylinder. The nut member 40 40 is moved downwardly along the cylinder 30, and the upper grindstone 14 is lowered a predetermined distance. As described in the foregoing, the clearance between the grindstones 14 and 16 is reduced by a predetermined amount. If this amount is not sufficient, a further pulse will be outputted from the preset counter 64, and the clearance between the grindstones 14 and 16 will be further corrected until it reaches the proper value.

When an extra long coil spring is found in the coil springs which have passed the grindstone 18 and the opposed grindstone for finish grinding, this coil spring is detected by one of the extra long coil spring detecting units 144 and 146, and in the foregoing manner, the clearance between the grindstones for finish grinding is automatically corrected to a proper value. The extra long coil spring detecting unit may be modified in various ways, and accordingly, this invention is not particularly limited to the foregoing illustrated embodiment, and also the unit for supplying the drive signal to the drive unit for changing the grindstone clearance only if a predetermined plurality of extra length coil springs are detected in a predetermined time, is not particularly limited to the preset counters 64, 66 and clock pulse generator 68 illustrated herein.

What is claimed is:

1. A spring grinding machine having a grindstone clearance correcting means, comprising:

a work table rotatably mounted for rotation in a predetermined direction and having a plurality of spring holding holes at equal intervals along the faces of the table concentric to the axis of rotation thereof for holding the coil springs to be ground;

at least one pair of grindstones for grinding coil springs disposed on opposite sides of the work table opposed to the path along which the spring holding holes move during rotation of said work table;

a grindstone clearance adjusting unit connected to said grindstones for driving the pair of grindstones toward each other in increments of a predetermined amount;

a spring length detecting unit disposed after the grindstones in the direction of rotation of the work table for detecting extra long springs in the spring holding holes which are longer than a predetermined length and outputting a signal each time an extra long spring is detected; and means connected between said spring length detecting means and said grindstone clearance adjusting unit for supplying an actuating signal to said grindstone clearance adjusting unit only after a predetermined number of signals have been received from said spring length detecting unit in a predetermined time.

2. A spring grinding machine having a grindstone clearance correcting correcting means, comprising:

a work table rotatably mounted for rotation in a predetermined direction and having a plurality of spring holding holes at equal intervals along the faces of the table concentric to the axis of rotation thereof for holding the coil springs to be ground;

a pair of rough grinding grindstones for rough grinding coil springs disposed on opposite sides of the work table opposed to the path along which the spring holding holes move during rotation of said work table, and a pair of finish grinding grindstones for finish grinding the rough ground coil springs disposed on opposite sides of the work table opposed to the path along which the spring holding holes move during rotation of said work table, and spaced from said rough grinding grindstones in the direction of rotation of said work table;

two grindstone clearance adjusting units, one connected to each of said pairs of grindstones for driving the respective pairs of grindstones toward each other in increments of a predetermined amount;

two spring length detecting units, one disposed after each of the respective pairs of grindstones in the direction of rotation of the work table for detecting extra long springs in the spring holding holes which are longer than a predetermined length and outputting a signal each time an extra long spring is detected; and two adjusting unit control means, one connected between each of the respective spring length detecting means and the corresponding grindstone clearance adjusting unit for supplying an actuating signal to the corresponding grindstone clearance adjusting unit only after a predetermined number of signals have been received from the corresponding spring length detecting unit in a predetermined time.

* * * * *